United States Patent [19]

Kaku et al.

[11] 3,960,612

[45] June 1, 1976

[54] METHOD FOR PRODUCING A LOW TEMPERATURE HIGH STRENGTH TOUGH STEEL

[75] Inventors: Katsuo Kaku; Hirofumi Yoshimura; Hiroshi Yada; Naoomi Yamada, all of Kitakyushu, Japan

[73] Assignee: Nippon Steel Corporation, Tokyo, Japan

[22] Filed: Aug. 7, 1974

[21] Appl. No.: 495,332

[30] Foreign Application Priority Data

Aug. 15, 1973 Japan ..... 48-90871

[52] U.S. Cl. ..... 148/12 F; 75/123 K; 148/36

[51] Int. Cl.[2] ..... C21D 7/14

[58] Field of Search ..... 148/12 F, 36; 75/123 K

[56] References Cited

UNITED STATES PATENTS

| | | | |
|---|---|---|---|
| 3,619,302 | 11/1971 | Aoki et al. | 148/12 F |
| 3,806,378 | 4/1974 | Bramfitt et al. | 148/12 F |
| 3,811,873 | 5/1974 | deBarbadillo | 75/123 K |

*Primary Examiner*—W. Stallard

*Attorney, Agent, or Firm*—Watson Leavenworth Kelton & Taggart

[57] ABSTRACT

A low temperature high strength tough steel is provided by effecting a series of heat treatments at predetermined temperatures.

The steel comprises C, Si, Mn, Ni, Mo, Nb, N, Al, and if necessary, V, Ti, Cr, Ca or Ce in predetermined amounts with the rest iron and unavoidable impurities.

6 Claims, 4 Drawing Figures

(X500)

(X500)

METHOD FOR PRODUCING A LOW TEMPERATURE HIGH STRENGTH TOUGH STEEL

DETAILED DESCRIPTION OF INVENTION

This invention relates to a method for the manufacture of a low temperature high strength tough steel having good weldability. More particularly, it relates to a method for the manufacture of such steel adapted for use as a low temperature pressure container to be used at temperatures below the ice point, or as a structural material such as a pipe line at a cold environment capable of standing high pressure and low temperature.

It has heretofore been a practice to use Mn-Mo steel known as API Standard X 65 - 70 (Yield Strength: 45 – 50 kg/mm²) for cold temperature welding structural material and to use 3.5% Ni steel of ASTM-A203 standard for use in extremely cold temperature application of welding structural material. Steel of this kind has, however, insufficient high strength and low temperature toughness to endure the severe environment conditions to be encountered.

Recently, structural material for low temperature welding having sufficient strength and low temperature toughness and containing 5.5 to 9.0% Ni has been developed. However, this material has also raised various problems and is considerably expensive.

In an attempt to develop structural material for low temperature welding having a yield strength of at least 45 kg/mm² and excellent toughness at such low temperatures as −50°C to −100°C with excellent workability and weldability, the inventors have made various studies and found that when a steel of Mo-Nb system containing a relatively small amount of Ni is subjected to heat treatments of one or two quenchings followed by tempering, the structure of the steel is made fine, which gives a structural material having excellent characteristics.

According to this invention, there is provided a method for producing a low temperature high strength tough steel which comprises the steps of; providing a steel material as hot-rolled comprising 0.03 – 0.15% C, 0.05 – 0.40 % Si, 0.2 – 2.0% Mn, 1.0 – 4.5% Ni, 0.1 – 0.5% Mo, 0.005 – 0.050% Nb, not more than 0.02% N, 0.005 – 0.070% Al, and if necessary, one or more than one member of the group consisting of V, Ti, Cr, Ca and Ce, the rest being iron and unavoidable impurities; quenching the material after heating at a temperature between 660° and 750°C; and then tempering the same after heating at a temperature of 650°C or less.

This invention is further described in detail with reference to the composition of the steel and the heat treatment thereof.

Table 1 indicates the effects that each component of the steel exerts upon the mechanical properties of the product.

C is an element which acts to promote the strength of the steel, while considerably lowering the toughness, particularly the toughness of the heat-affected parts. Accordingly, the C component of this invention should range between 0.03 and 0.15%. When it is less than 0.03%, appreciable promotion of the strength can not be observed. On the other hand, when it is more than 0.15%, the low temperature toughness will be greatly deteriorated.

Si is an element which acts to enhance the strength of the steel like C and then used as a deoxidizing agent for steel making process. This effect can not be obtained in the range below 0.05%, while the toughness of the steel becomes lowered in the range above 0.5%. Consequently, the content of Si should be between 0.05 and 0.50%.

Mn is, like Si, used as a deoxidizing agent for steel making process. It is an element which enhances the strength of the steel by a solid solution and producing martensite when the content of Ni is very small. This effect can be realized in the Mn content of 0.2% or more. However, the amount of Mn in excess of 2.0% lowers the toughness of the steel. In view of this behavior of Mn, the amount of Mn should be 0.2 to 2.0%.

Ni is added as an element to promote the strength and the low temperature toughness of the steel, and amount to be added is between 1.0 and 4.5%. The amount of Ni outside this range will give a disadvantage with respect to the effect or from the economical viewpoint.

Mo is an effective element which acts to promote the strength of the steel by the secondary hardening due to the deposition of Molybdenum carbide as well as to prevent tempering brittleness. In order to achieve this effect, Mo should be contained in an amount between 0.1 and 0.5%. If it is less than 0.1%, its effect can not be observed at all.

If, however, it is more than 0.5%, the low temperature toughness of the steel becomes lowered.

Table 1

| Steel | Steel Component (%) | | | | | | | Yield | Toughness | |
|---|---|---|---|---|---|---|---|---|---|---|
| | C | Si | Mn | Ni | Mo | Nb | Others | Strength (kg/mm²) | vE-60 (kg-m) | vTrs (°C) |
| 1 | 0.02 | 0.31 | 0.96 | 2.16 | 0.31 | 0.012 | | 40.1 | 20.1 | −85 |
| 2 | 0.03 | 0.28 | 1.02 | 2.45 | 0.39 | 0.010 | | 45.2 | 22.1 | −100 |
| 3 | 0.06 | 0.16 | 1.01 | 2.22 | 0.21 | 0.011 | | 48.2 | 21.5 | −120 |
| 4 | 0.14 | 0.32 | 0.99 | 2.29 | 0.22 | 0.015 | | 60.1 | 15.1 | −100 |
| 5 | 0.16 | 0.29 | 1.12 | 2.61 | 0.20 | 0.018 | | 65.1 | 11.1 | − 85 |
| 6 | 0.06 | 0.42 | 1.00 | 2.31 | 0.21 | 0.018 | | 49.1 | 10.5 | − 60 |
| 7 | 0.05 | 0.30 | 1.80 | 1.80 | 0.22 | 0.011 | | 47.5 | 17.5 | − 80 |
| 8 | 0.05 | 0.31 | 2.10 | 1.80 | 0.21 | 0.018 | | 51.5 | 15.1 | − 75 |
| 9 | 0.06 | 0.28 | 1.01 | 1.20 | 0.22 | 0.018 | | 44.1 | 16.5 | − 70 |
| 10 | 0.05 | 0.21 | 0.99 | 1.50 | 0.21 | 0.014 | | 45.6 | 16.5 | − 80 |
| 11 | 0.07 | 0.22 | 1.02 | 3.50 | 0.23 | 0.015 | | 48.5 | 13.1 | −120 |
| 12 | 0.07 | 0.24 | 1.02 | 4.20 | 0.23 | 0.014 | | 48.9 | 15.1 | −130 |
| 13 | 0.08 | 0.25 | 1.01 | 2.44 | 0.09 | 0.011 | | 45.1 | 15.1 | −110 |
| 14 | 0.06 | 0.21 | 1.03 | 2.41 | 0.51 | 0.011 | | 61.0 | 9.0 | − 60 |
| 15 | 0.06 | 0.21 | 1.03 | 2.41 | 0.21 | 0.011 | Ti:0.05 | 49.3 | 20.5 | −125 |
| 16 | 0.06 | 0.25 | 0.50 | 2.30 | 0.25 | 0.018 | Cr:0.50 | 47.1 | 20.8 | −120 |
| 17 | 0.05 | 0.24 | 1.02 | 2.41 | 0.22 | 0.012 | Ce:0.02 | 48.9 | 22.5 | −125 |
| 18 | 0.06 | 0.25 | 1.05 | 2.48 | 0.23 | 0.011 | Ca:0.02 | 48.8 | 21.5 | −125 |
| 19 | 0.06 | 0.21 | 0.91 | 2.46 | 0.21 | 0.010 | N :0.005 | 48.1 | 20.1 | −120 |
| 20 | 0.05 | 0.23 | 0.98 | 2.39 | 0.21 | 0.012 | N :0.011 | 49.9 | 21.1 | −120 |

Table 1-continued

| Steel | Steel Component (%) | | | | | | | Yield | Toughness | |
|---|---|---|---|---|---|---|---|---|---|---|
| | C | Si | Mn | Ni | Mo | Nb | Others | Strength (kg/mm²) | vE-60 (kg-m) | vTrs (°C) |
| 21 | 0.06 | 0.25 | 0.96 | 2.51 | 0.22 | 0.011 | N :0.025 | 52.1 | 14.1 | − 85 |

Sample Steel Plate
Plate Thickness 19 mm
quench (880°C)→quench (700°C)→temper (600°C)

Nb is an element capable of making the structure finer after quenching to thereby promote the low temperature toughness. FIG. 1 shows the low temperature toughness obtained, (a) when steel of 0.06% C – 1% Mn – 2.5% Ni – 0.2% Mo to which varied amounts of Nb have been added is quenched from a temperature of 880°C, further quenched from 700°C and tempered at 600°C, and (b) when it is further subjected to a welding heat cycle (heated to 1350°C) after the above mentioned heat treatment. This shows that Nb is effective in an amount of 0.005 to 0.050% as an element which acts to promote the low temperature toughness. However, content of Nb in excess will greatly deteriorate the toughness for the welding heat affected part.

N contributes to the enhancement of the strength and the toughness of the steel because it combines with V, Ti, etc. hereinafter mentioned to form nitrides so that the structure becomes fine. However, in the steel of this invention containing C in an amount between 0.03 and 0.15%, an excess amount of N more than 0.02% will lower the toughness of the steel.

Al may be added as a deoxidizing agent in an amount of 0.005 to 0.07%.

P, S, etc. contained in the steel as unavoidable impurities should be avoided as far as possible since they are harmful elements which will deteriorate the properties of the steel.

In order to further enhance the toughness of the steel having the above stated composition, one or more than one member of the group consisting of V, Ti, Cr, Ca and Ce may be added thereto in a small amount.

V will serve to deposit V-carbides or -nitrides, giving secondary hardening to thereby enhance the strength of the steel. To achieve this effect, it is necessary to add V in an amount of at least 0.005%, but an amount more than 0.1% will greatly injure the low temperature toughness of the steel.

Ti should be contained in an amount between 0.005 and 0.10% because it will form a finely-divided structure whereby strength and toughness are enhanced.

Cr should be contained in an amount between 0.2 and 1.0% as an element which acts to enhance the quench charateristics of the steel and hence the strength thereof as well as the toughness of the welding heat affected part.

Ca and Ce should be contained in an amount between 0.005 and 0.3% as an element acting to relieve the anisotropy caused by rolling as well as to enhance the toughness of the steel.

The steel material in the form of plates, rods, etc. having the composition according to the invention can be manufactured as follows.

The molten steel obtained by the use of a converter, electric furnace or other smelting furnaces, and if necessary, a vacuum degassing apparatus is formed into a slab through the steps of ingoting, blooming or continuous casting, and then hot-rolled to the steel material. The steel material as hot-rolled can be any type, but it is preferable that the crystal grain thereof is larger than the crystal grain size No. 5 of JIS and that the space factor is below 80%, and the smaller, the better. In order to make finer the structure of the steel as hot-rolled, the steel material used may be that which have been heated at a temperature between 840° and 930°C and quenched therefrom.

The steel material which can thus be manufactured by hot rolling with or without the subsequent heat treatment is subjected to the quench treatment of heating at 660° to 750°C, followed by rapid cooling, whereby extremely fine structure can be obtained, which results in the enhancement of the low temperature toughness. This steel material is further subjected to a temper treatment at a temperature of 650°C or less, (preferably at least 400°C), whereby the strength and the toughness are enhanced and the cold workability and the brittleness due to strain aging can be improved.

In the heat treatment like this, it can be considered that the steel material which has been subjected to the normalizing treatment after hot rolled is used. However, it weakens the effect of making the structure fine and does not give as much effect as the quench treatment.

The steel material manufactured according to this invention is quite excellent in respect of the strength and the low temperature toughness of the steel.

Further aspects of the invention can be understood with reference to the accompanying drawings in which:

FIG. 1 is a graph showing the low temperature toughness obtained when the steel of 0.06%C — 0.21% Si — 1.0% Mn — 2.51% Ni — 0.2% Mo with varied amount of Nb(%) is subjected to the heat treatment (quench 880°C → quench 700°C → temper 600°C) and when it is further subjected to the welding heat cycle (heating at 1350°C).

FIG. 2 is a graph showing the yield strength and the low temperature toughness obtained when the steel of 0.06% C — 0.2% Si — 1.0% Mn — 2.5% Ni — 0.21% Mo — 0.01% Nb with varied amount of V(%) is subjected to the heat treatment (quench 880°C → quench 700°C → temper 600°C).

EXAMPLE

The methods according to this invention and according to the conventional method using the steel having the same composition are shown in Table 2 together with the mechanical properties obtained.

Figure 1:
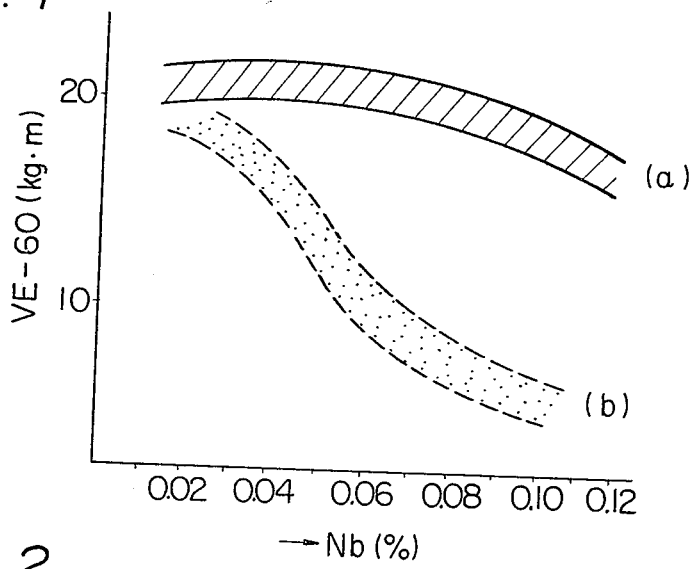
Figure 2:
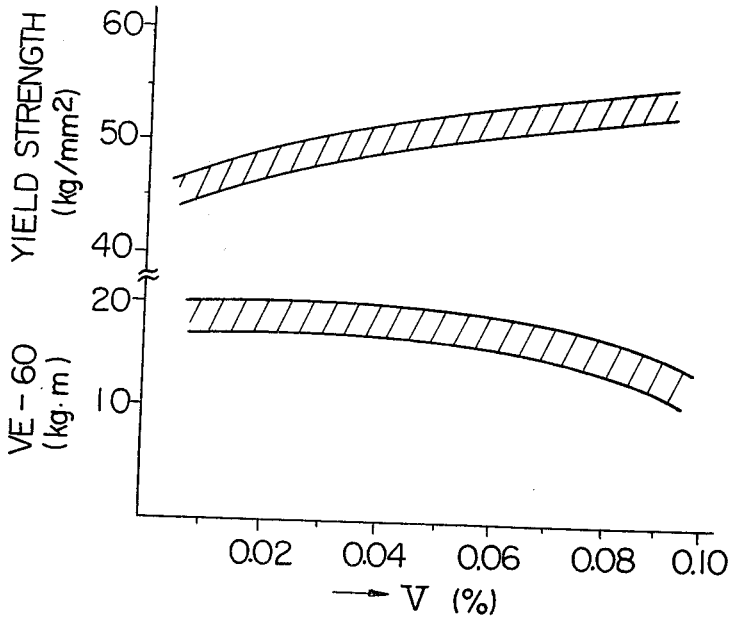
Figure 3:
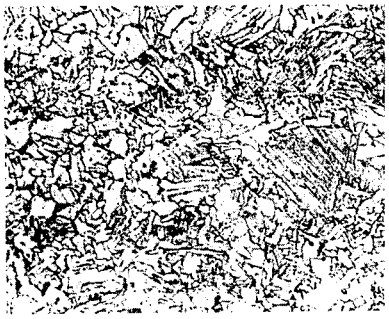
FIG. 3 is a microscopic photograph showing the steel structure in Example according to the conventional heat treatment.
Figure 4:
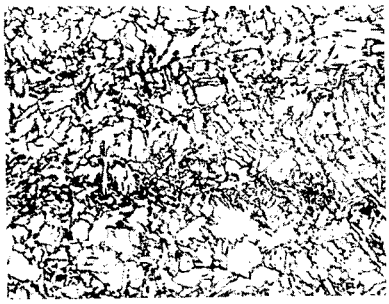
FIG. 4 is a microscopic photograph showing the steel structure in Example according to the heat treatment of this invention.

The microscopic photographs shown in FIGS. 3 and 4 show the steel structure concerned above.

Table 2

| Steel Component | Heat treatment | Yield strength (kg/mm²) | Tensile strength (kg/mm²) | Yield ratio | Toughness vE-60 (kg.m) | Toughness vTrs (°C) | Remarks |
|---|---|---|---|---|---|---|---|
| (%) 0.07 C - 0.2 Si - 0.9 Mn - 2.5 Ni - 0.2 Mo - 0.02 Nb - 0.02 Al - 0.005 N | quench → temper (880°C) (650°C) | 55.1 | 57.5 | 0.96 | 12.1 | − 90 | Conventional method |
| | quench → quench (800°C) (700°C) → temper (600°C) | 48.5 | 57.0 | 0.85 | 21.5 | −130 | |
| | After rolling → quench (700°C) → temper (600°C) | 46.7 | 57.1 | 0.82 | 15.1 | −100 | This Invention |
| (%) 0.06 C - 0.18 Si - 1.0 Mn - 2.4 Ni - 0.2 Mo - 0.02 Nb - 0.03 V - 0.02 Al - 0.005 N | quench → temper (880°C) (650°C) | 59.0 | 62.1 | 0.95 | 10.1 | − 90 | Conventional method |
| | quench → quench (880°C) (700°C) → temper (600°C) | 51.9 | 61.0 | 0.85 | 20.1 | −125 | |
| | After rolling → quench (700°C) → temper (600°C) | 49.2 | 60.2 | 0.82 | 14.5 | −100 | This Invention |

Thickness 19 mm

It is obvious from the foregoing Example that according to this invention there is obtained a low temperature high strength tough steel which gives somewhat lower yield strength but extremely good toughness with fine grain structure, as compared with the conventional method.

We claim:

1. A method for producing a low temperature high strength tough steel which comprises steps of; providing a steel material as hot-rolled which comprises in addition to iron and unavoidable impurities, the following essential ingredients 0.03 – 0.15% C 0.05 – 0.04% Si, 0.2 – 2.0% Mn, 1.0 – 4.5% Ni, 0.1 – 0.5% Mo, 0.005 – 0.050% Nb, up to and including 0.02% N, and 0.005 – 0.070% Al; quenching said steel material after heating at a temperature between 660°C and 750°C; and then tempering the same after heating at a temperature of 650°C or less.

2. A method for producing a low temperature high strength tough steel which comprises steps of; providing a steel material subjected to hot rolling and then to quenching after heated at a temperature between 840° and 930°C and which comprises in addition to iron and unavoidable impurities, the following essential ingredients 0.03 – 0.15% C, 0.05 – 0.40% Si, 0.2 – 2.0%MN, 1.0 – 4.5% Ni, 0.1 – 0.5% Mo, 0.005 – 0.050% Nb, up to and including 0.02% N, and 0.0005 – 0.70% Al; quenching said steel material after heating at a temperature between 660° and 750°C; and then tempering the same after heating at a temperature of 650°C or less.

3. A method according to claim 1 in which said steel material further contains at least one member selected from the group consisting of V, Ti, Cr, Ca and Ce in an amount of 0.005 to 0.10% V, 0.005 to 0.10% Ti, 0.2 to 1.0% Cr, 0.005 to 0.03% Ca, or 0.005 to 0.03% Ce.

4. A method according to claim 2 in which said steel material further contains at least one member selected from the group consisting of V, Ti, Cr, Ca and Ce in an amount of 0.005 to 0.10% V, 0.005 to 0.10% Ti, 0.2 to 1.0% Cr, 0.005 to 0.03% Ca, or 0.005 to 0.03% Ce.

5. A method according to claim 1 in which the temperature for tempering is between 650° and 400°C.

6. A method according to claim 2 in which the temperature for tempering is between 650° and 400°C.

* * * * *

UNITED STATES PATENT OFFICE

CERTIFICATE OF CORRECTION

PATENT NO. : 3,960,612

DATED : June 1, 1976

INVENTOR(S) : Katsuo KAKU, Hirofumi YOSHIMURA and Hiroshi YADA

It is certified that error appears in the above-identified patent and that said Letters Patent are hereby corrected as shown below:

At Col. 5, line 34, (Claim 1), "ingredients 0.03 - 0.15%C 0.05 - 0.04%" should read --ingredients 0.03 - 0.15%C, 0.05 - 0.40%--.

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*